US008764346B1

(12) United States Patent
Srinivasan

(10) Patent No.: US 8,764,346 B1
(45) Date of Patent: Jul. 1, 2014

(54) TENSION-BASED TENSION LEG PLATFORM

(76) Inventor: Nagan Srinivasan, Missouri City, TX (US)

( * ) Notice: Subject to any disclaimer, the term of this patent is extended or adjusted under 35 U.S.C. 154(b) by 0 days.

(21) Appl. No.: 13/154,440

(22) Filed: Jun. 7, 2011

Related U.S. Application Data

(60) Provisional application No. 61/352,283, filed on Jun. 7, 2010.

(51) Int. Cl.
*E02D 5/34* (2006.01)
*E02D 5/40* (2006.01)
*B63B 21/50* (2006.01)

(52) U.S. Cl.
CPC ..... *B63B 21/502* (2013.01)
USPC ..... 405/223.1

(58) Field of Classification Search
USPC ..... 405/195.1, 223.1, 224, 203, 205, 207, 405/208
See application file for complete search history.

(56) References Cited

U.S. PATENT DOCUMENTS

| | | | | | |
|---|---|---|---|---|---|
| 3,982,401 | A * | 9/1976 | Loggins | 405/200 |
| 4,078,584 | A * | 3/1978 | Behar et al. | 138/107 |
| 4,181,453 | A * | 1/1980 | Vache | 405/203 |
| 4,473,323 | A * | 9/1984 | Gregory | 405/224.4 |
| 4,516,882 | A * | 5/1985 | Brewer et al. | 405/224 |
| 4,521,135 | A * | 6/1985 | Silcox | 405/223.1 |
| 4,674,918 | A * | 6/1987 | Kalpins | 405/224 |
| 4,913,591 | A * | 4/1990 | Steele | 405/196 |
| 5,551,802 | A * | 9/1996 | Wybro | 405/223.1 |
| 5,707,178 | A * | 1/1998 | Srinivasan | 405/223.1 |
| 6,161,620 | A * | 12/2000 | Cox et al. | 166/367 |
| 6,551,029 | B2 * | 4/2003 | Shu et al. | 405/211 |
| 6,899,492 | B1 * | 5/2005 | Srinivasan | 405/205 |
| 7,270,071 | B1 * | 9/2007 | Shivers et al. | 114/265 |
| 7,281,881 | B1 * | 10/2007 | Cermelli et al. | 405/203 |
| 7,963,241 | B2 * | 6/2011 | Srinivasan | 114/267 |
| 2002/0031404 | A1 * | 3/2002 | Junio et al. | 405/223.1 |
| 2002/0067958 | A1 * | 6/2002 | Seguin | 405/223.1 |
| 2004/0028479 | A1 * | 2/2004 | Horton, III | 405/223.1 |
| 2004/0052586 | A1 * | 3/2004 | Horton, III | 405/223.1 |
| 2004/0105724 | A1 * | 6/2004 | Copple et al. | 405/195.1 |
| 2007/0224000 | A1 * | 9/2007 | Mills et al. | 405/203 |
| 2007/0286683 | A1 * | 12/2007 | Bull et al. | 405/195.1 |
| 2009/0145611 | A1 * | 6/2009 | Pallini et al. | 166/355 |
| 2009/0205554 | A1 * | 8/2009 | Srinivasan | 114/264 |
| 2010/0186965 | A1 * | 7/2010 | Wille et al. | 166/350 |
| 2011/0074155 | A1 * | 3/2011 | Scholte-Wassink | 290/44 |
| 2011/0305521 | A1 * | 12/2011 | Henstra et al. | 405/198 |
| 2012/0063850 | A1 * | 3/2012 | Collins | 405/205 |

* cited by examiner

*Primary Examiner* — Sean Andrish
*Assistant Examiner* — Patrick Lambe
(74) *Attorney, Agent, or Firm* — Kenneth A. Roddy

(57) ABSTRACT

A tension-based tension leg platform (TBTLP) for use in ultra deepwater applications to support dry-tree oil and gas production utilizes a tension base or artificial seabed that simplifies tendon design at deepwater locations in harsh environment and has a truss pontoon structure that reduces vertical and horizontal wave loadings. The platform may include a riser support tower that makes production risers feasible in 8,000 ft water depths without riser pretension to the hull and reduces or eliminates vortex induced vibration problems.

11 Claims, 12 Drawing Sheets

TLP MOTION GEOMETRY

TENSION-BASED TENSION LEG PLATFORM

CROSS REFERENCE TO RELATED APPLICATION

This application claims priority of U.S. Provisional Application Ser. No. 61/352,283 filed Jun. 7, 2010.

BACKGROUND OF THE INVENTION

1. Field of the Invention

This invention relates generally to offshore floating structures, and, more particularly to a tension-based tension leg platform (TBTLP) for use in ultra deepwater to support dry-tree oil and gas production which utilizes a tension base or artificial seabed to simplify tendon design at deep water locations in harsh environment and a truss pontoon to reduce vertical and horizontal wave loadings.

2. Background Art

Oil and gas companies have used Tension Leg Platforms (TLP) for production in deepwater since 1980 until the alternate Truss-SPAR technology was developed and tested in the Gulf of Mexico. The TLP is an excellent and reliable technology because it has proven behavior in the harsh environment of deepwater. The industry takes no risk in using this technology because several technical issues had been solved in the real world. The TLP is moored to the seabed by high tensile strength steel tubes called tendons which allow very little vertical motion to the platform. There are over twenty TLPs in operation in the Gulf of Mexico, the North Sea, offshore Indonesia and West Africa. Shell Oil Company had developed several of its deepwater oil fields with TLP technology in the Gulf of Mexico and is currently working on MARS TLP phase 2 with TLP concept in 3000 ft water depth. BHP Billiton has the intention to use a TLP for the Shenzi development in 4,300 ft deepwater of the Gulf of Mexico for 100 kBD of oil and 50 million cubic feet per day of gas. Shenzi is located 120 miles off Louisiana shore in Green Canyon Block 653.

The water depth limitation of this TLP technology is less than 5000 ft for several technical reasons that are discussed hereinafter. The engineering and construction companies that serve the oil companies designed several geometric variations to the TLP technology in order to make it cost effective in applications at water depths for the given deck pay load capacity. Of course environmental conditions are also key factors in the design of the TLP like any other offshore platforms.

The oil and gas industry has in-depth knowledge about the TLP design for the given application factors. The regulatory world also has established full depth standards for the classing of the structure. FIG. 1 shows a typical conventional TLP of the prior art with conventional hull, tendons, deck, production risers etc. FIG. 2 shows, schematically, the 2-D geometric displaced position of the conventional TLP in sway with pitch and set-down relationship. The TLP may be used as a processing and/or wellhead platform. Drilling and work-over capability may be provided with the tendon assisted rigs. Storage can be provided with an independent floating storage unit (FSU) vessel or SPAR.

Although the TLP looks like a floating vessel, in the operational mode, it behaves like a fixed structure in the heave, roll and pitch motions and thus enables support of a conventional dry-tree production system. The excess buoyancy designed in the hull with vertical columns and conventional pontoons keeps the tendons in tension to be effective in all wave environments for the given deck load. A TLP tendon requirement to keep the vessel concept effective within the practical cost budget is limited by the water depth. If the TLP's heave or pitch or roll periods become longer than 4-5 seconds, then the dynamic system is susceptible to direct wave energy at resonance. That leads to motions and severe fatigue problems. When the tendons become longer according to the water depth, they are required to be larger in size in cross section to maintain the same stiffness. At water depths close to 5000 ft, the weight of the tendons becomes impractical. The vessel size to always maintain the tendons in tension becomes uneconomically large. Several alternatives had been proposed utilizing composite materials instead of steel for the tendons which may provide weight savings. However, they are not yet practical from the standpoint of cost. The present invention introduces innovative technologies to enhance TLP applications in water depths of over 8000 ft.

Ultra Deepwater Problems

As discussed above, one of the problems in extending TLP technology to ultra deepwater applications is that the TLP is sensitive to topside deck load because it loses its pretension capacity with respect to the topside weight for the given hull buoyancy. The hull weight to total displacement ratio for the given deck load for the range of water depths that is feasible for TLP is almost same as for a semi-submersible structure. The current technology allows the TLP to be designed for water depth of 4500 ft with a topside deck payload of 20,000 tons for the Gulf of Mexico environment. The most attractive feature of the TLP is its application for dry-tree support in the production platform. Subsea well solutions although attractive in deepwater, requires well intervention when the well is not producing as expected and becomes expensive. Many wells have been abandoned because the cost-effectiveness to fix them in the deep water with subsea wells.

Thus, the TLP offers a good option for simplifying well intervention when a well develops problems or needs well enhancement. From the well maintenance cost point of view, the TLP is a better option than a semi-submersible unless it is a dry-tree support semi-submersible. As stated earlier, the TLP has a water depth limitation problem utilizing steel tendons. The vessel size is also large when the water depth increases to over 4000 ft. Consequently, the installation of the vessel becomes difficult as the water depth increases beyond 5000 ft. Stepped tendons and composite materials have been offered as a solution to the tendon engineering problem.

Water depth increases have more serious problems with the TLP applications. One of them is the riser pretension. The increased water depth increases the riser weight and thus increases the pretension. The second effect on the riser is due to the external water pressure in deepwater. This typically results in larger wall thickness for the risers. This solution further increases the riser weight and the riser pretension requirements. Ultra deepwater developments become economic if drilling support is on the deck. Table 1, below, gives a typical load estimation for a TLP in the Gulf of Mexico at an 8000 ft water depth and in drilling and production of 100 (kBD) oil applications. It should be noted that the riser pretension, the SCR and the umbilical down preloads exceed deck payload by 1.6 times in ultra deepwater. The total down load required to be supported by the TLP to work in 8000 water depth is 80,000 short tons. In addition to that, the displacement of the vessel should take care of the tendon preloads. Thus the TLP vessel size becomes unusually large and the tendons design becomes challenging, and development of a new technology is required to use TLP in ultra deepwater fields.

TABLE 1

| Estimation of Weight, GOM-TLP | |
|---|---|
| Water Depth | 8000 ft |
| 100 yr Wave | Hs = 51.8 ft & Tp = 15.2 s |
| Production oil, gas | 100 kBD & 50 mcftpd |
| Deck Pay Load | 17,000 short tons |
| Deck Self Weight | 7,000 short tons |
| Hull Weight | 29,000 short tons |
| Riser Tension | 21,000 short tons |
| SCR + Umbilical | 6,000 short tons |
| Total Down Load | 80,000 short tons |

The Shell Ursa TLP uses 14.0 inch OD and 0.75 inch wall thickness and 10⅞ inch OD and 0.608 inch wall thickness production risers for the Gulf of Mexico 4000 ft water depth. Engineering challenges are being realized for 10,000 ft water depth and 10,000 psi internal pressure for the Gulf of Mexico ultra deepwater applications in the riser design. For this design, significant increase in diameter and wall thickness of the risers is seen. Subsequently, the top tension requirement for the risers also increases. Thus, designing a TLP for ultra deepwater has three basic problems: (1) Vessel Size, (2) Tendon Design, and (3) Riser Design. The present invention meets these challenges to bring the TLP within technical feasibility and cost effectiveness for the ultra deepwater depths.

DESCRIPTION OF THE PREFERRED EMBODIMENTS

Figure 3:
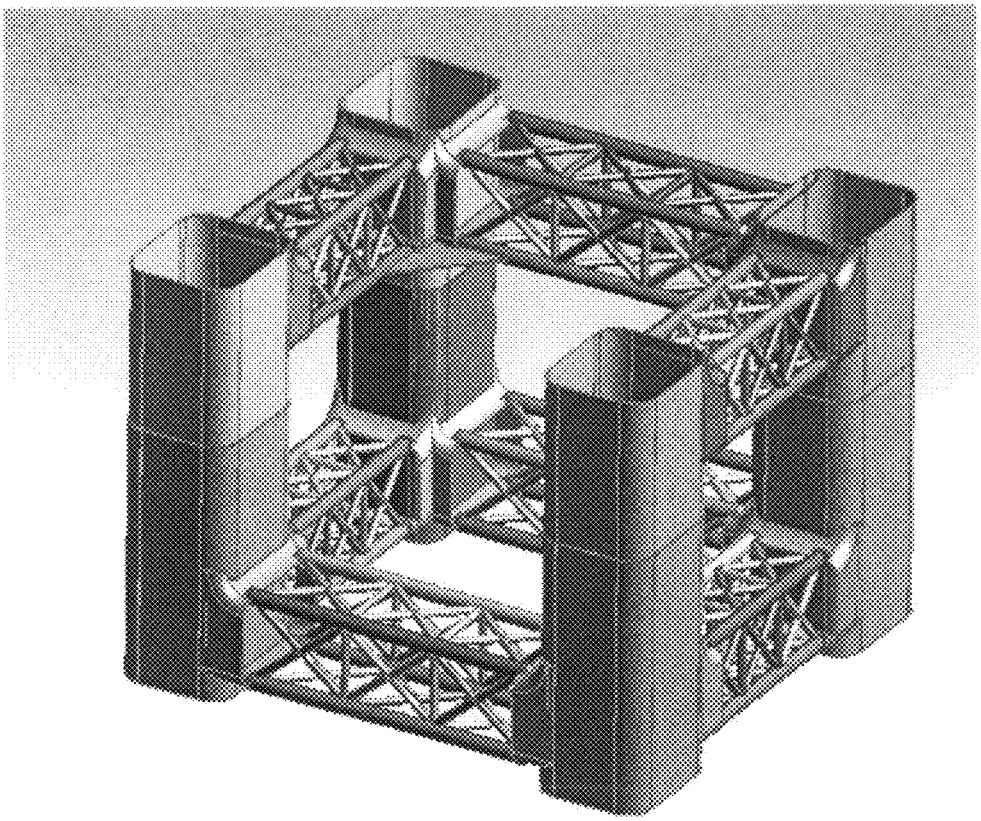
FIG. 3 is a perspective view of a modified TLP with a generally C-shaped hull and truss pontoons.

Truss-Pontoon to TLP:

Referring now to FIG. 3, in order to achieve the above three goals, first a modified truss pontoon type hull is used in the present tension-based tension leg platform, for example, a truss pontoon type hull as shown and described in my U.S. Pat. No. 6,761,124, titled "Column-Stabilized Floating Structures with Truss-pontoons", which is hereby incorporated by reference in its entirety. A semi-submersible platform having lateral trusses, a rectangular deck mount structure or a three-sided deck mount structure at the top of the columns open on one side to allow on-site float-over deck installation, and outwardly extending tendon support frame at the lower end of the columns, is shown and described in my pending U.S. patent application Ser. No. 12/378,888, titled "Dry Tree Semi-Submersible Platform For Harsh Environment And Ultra Deepwater Applications", which is hereby incorporated by reference in its entirety.

Removing the pontoon from the conventional TLP provides several advantages. It makes the design of the tension-based tension leg platform (TBTLP) hull simple. It provides three or four or even more vertical columns that take the vertical load needed for the water displacement. The columns are connected by a submerged open framework truss at the bottom. The truss members are designed such that they are neutrally buoyant. The truss is a structural member with pinned connection behavior at the column flat face. The load on the truss for fatigue is negligible in everyday waves due to the deep draft. Deep draft would be required for large deck load. The column size and the platform size are limited from the shipyard feasibility of construction. Columns may be spaced center to center at a distance of 50 m (165 ft) to 65 m (215 ft). Square columns are used for more water displacement capacity and also for the ease of fabrication. The draft may be assumed to be 31 m (100 ft) and the free board is assumed to be 25 m (100 ft). The total column height is 60 m (200 ft). If the size of the square column side is based on the total displacement required to meet the conditions as per Table 1, then the TBTLP hull sizing is simplified compared to the conventional pontoon type TLP. However with the help of the truss pontoon concept, the structural weight of the hull is reduced significantly compared to the use of conventional pontoons. Consequently the fabrication effort is reduced.

The top side of the vertical columns may also be integrated with an open framework truss. In the illustrated example, a generally C-frame type structural concept is provided for the TBTLP hull to allow float-over deck installation. The C-frame uses knee-braces (not shown) to provide stiffness to the columns and resistance to moving towards the open-face.

When the conventional TLP heave/pitch/roll period becomes longer than 4-5 seconds, the system is susceptible to direct wave energy at resonance, leading to fatigue failure. The weight estimation in Table 1 is revised and reproduced in Table 2, below, to illustrate the characteristics of the TBTLP truss-pontoon hull shown in FIG. 3. The natural heave of this hull in a free float without tendons would be 10.85 sec. However, the TBTLP is a fixed structure, and the natural heave of the structure is determined with the tendon axial stiffness and added mass of the hull. Replacing the conventional shell pontoon with the submerged truss-pontoon reduces the added mass of the TBTLP hull and consequently the vertical and the horizontal forces on it. The reduction of vertical and horizontal wave forces reduces the heave and surge forces and the displacement. This significantly aids in extending the tendons to the deepwater.

TABLE 2

| Estimation of Weight, GOM-TLP | |
|---|---|
| Water Depth | 8000 ft |
| 100 yr Wave | Hs = 51.8 ft & Tp = 15.2 s |
| Production oil, gas | 100 kBD & 50 mcftpd |
| Deck Pay Load | 17,000 short tons |
| Deck Self Weight | 7,000 short tons |
| Hull Weight | 22,000 short tons |
| Riser Tension | 21,000 short tons |
| SCR + Umbilical | 6,000 short tons |
| Total Down Load | 73,000 short tons |

Slim-Hull TLP with Truss Pontoon

Assume that the heave natural period of the conventional TLP is close to 5 sec. That is within the energy region of the ocean environment to excite the tendons to the vertical resonance and causes serious fatigue problems to the tendons life. In the present TBTLP, the wave exciting forces on the vessel are minimized with present truss pontoon structure. The vertical wave forces are much smaller than the conventional TLP. Since the excitation force in the vertical direction is reduced significantly, its effect is also reduced at resonant heave. Wave induced fatigue loads on structures in the ocean are due to high sea state with waves of 3-7 second periods. For those periods of waves, the water particle kinematics is minimum or negligible for the present submerged truss structures. Since the column provides the required buoyancy for the vessel, the columns are deep draft. Part of the column shell at the bottom is extended out on the side shell of the columns to receive the truss members' connection. The truss member tubes are split in the middle and the column extended plate is inserted in the sleeve and welded. Thus, the fatigue load on the open truss bridge structure is not a serious problem in this design.

The truss members are drag dominated and produce separation of the water flow and causes damping of the system. However, the hull is inertia wave force dominated which is 90° out of phase with the drag forces. Drag damping due to the small diameter horizontal truss frame is effective at the vertical heave resonance. Thus, the TBTLP tendons could be designed to the vertical heave close to or just over 5 sec.

This enables the use of a TLP in ultra deepwater by controlling the natural period of the system by replacing the pontoons from the hull. The C-frame truss or box shell may be selectively placed at the top of the vertical columns to provide adequate structural integrity to the TLP. Hydrodynamic balance is applied in the slim-hull for the TLP application of FIG. 3. This technology reduces the natural period and heave, pitch and roll of the hull, which reduces the requirement for additional tendon steel to adjust the stiffness. The benefit is the smaller dynamic tensions for the tendons that are utilized in extending the water depth application. Notably the horizontal offset due to the wave forces also reduced.

Extended Arm Truss-Pontoon

Figure 4:
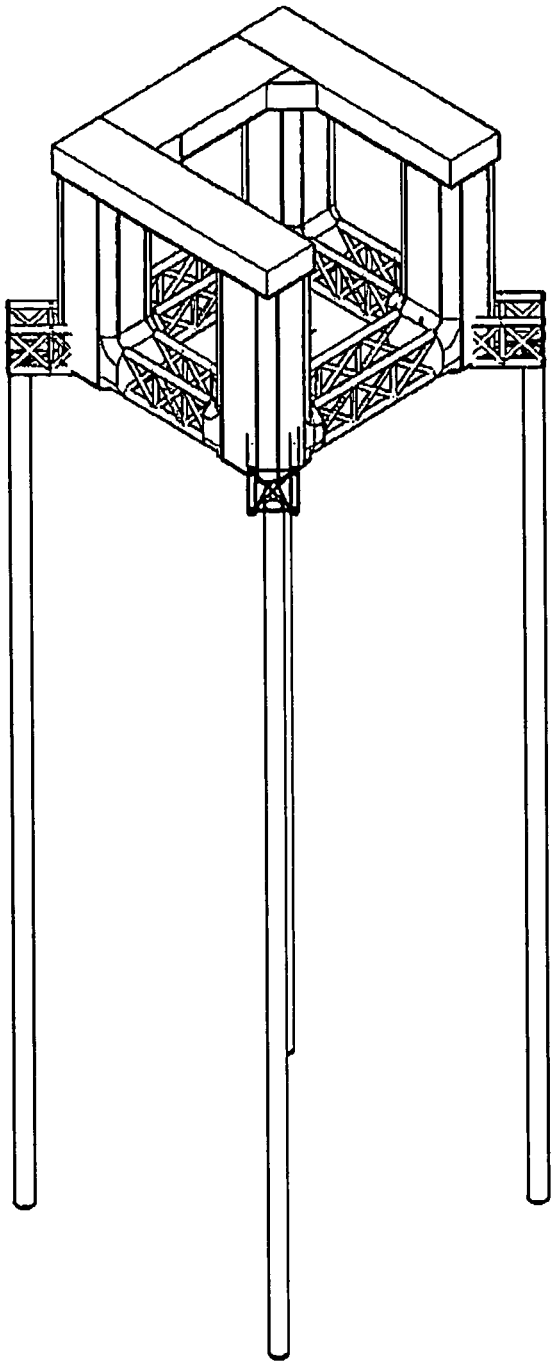
FIG. 4 is a perspective view of a cantilever extended arm truss pontoon TLP.

FIG. 4 shows a cantilever extended-arm system applied to the truss-pontoon TLP. A semi-submersible platform having outwardly extending tendon support frames at the lower end of the columns is shown and described in my pending U.S. patent application Ser. No. 12/378,888, titled "Dry Tree Semi-Submersible Platform For Harsh Environment And Ultra Deepwater Applications", which is hereby incorporated by reference in its entirety. The pontoon extensions move the tendon connection point outboard of the columns by say 20 m (65 ft) to 25 m (82 ft) from the center of the square column. The clear extended length could be say 10 m (30 ft) to 12 m (40 ft). This configuration effectively increases the restoring effect of the tendons and thus reduces the column spacing requirements. It makes the deck span reasonable within the fabrication limit of the shipyard and the application requirements. The pontoon extensions also significantly reduce the fatigue loading and the pretension requirement on the tendons and enhance the water depth capacity.

The two techniques discussed above improve the water depth capability of a TLP significantly. For an example, a TLP designed for a 4000 ft water depth may be extended to a 5000 ft or 5500 ft water depth. However, dramatically increasing the water depth from 4000 ft to 8000 ft is not feasible without "tension base" (TB) technology. Further research and application studies on this concept by engineers and scientist are attractive considering deepwater oil and gas developments.

Tension Base Tension Leg Platform

Figure 5:
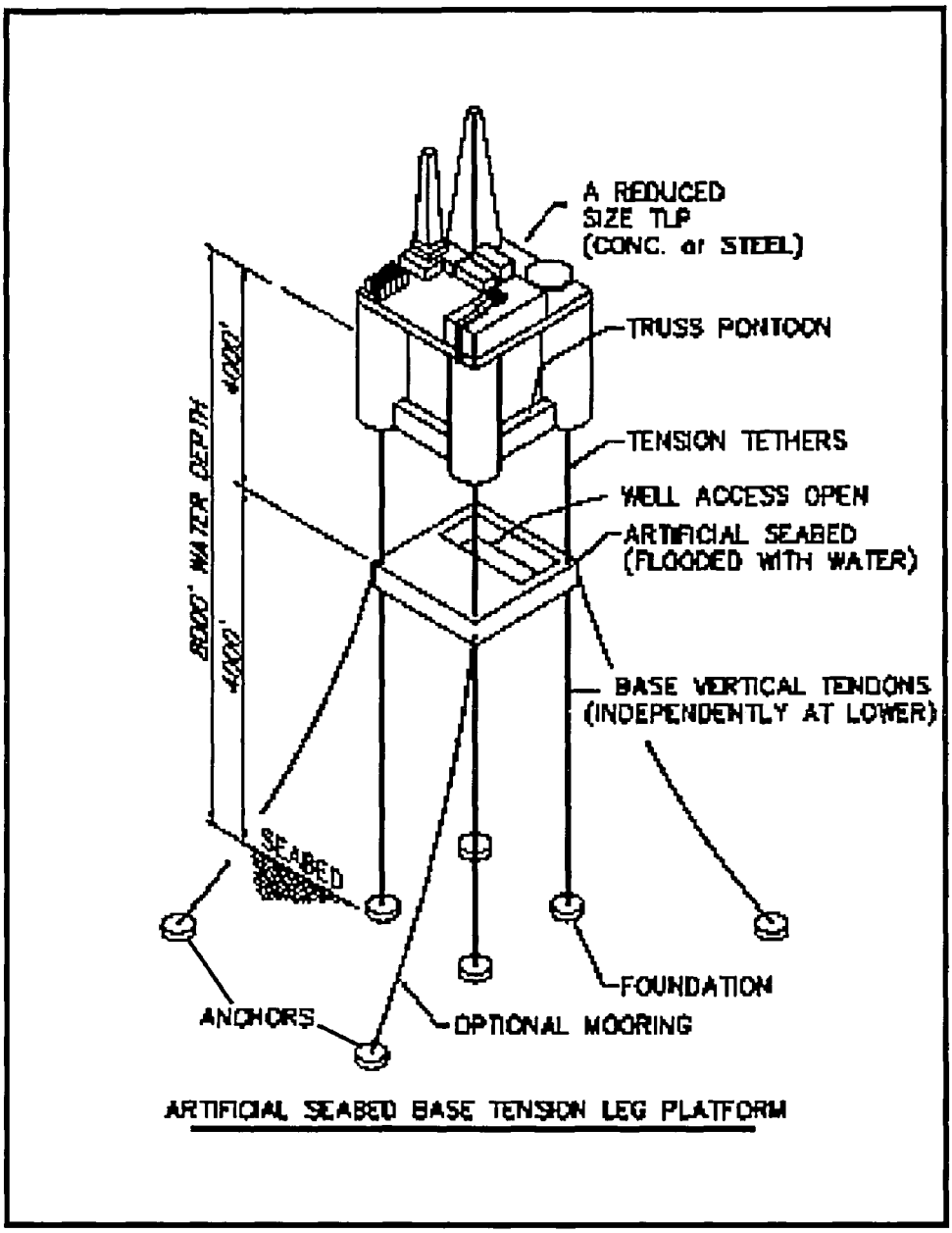
FIG. 5 is a perspective view of a tension based tension leg platform (TBTLP) which utilizes an artificial seabed at a water depth that enables a TLP to work technically and economically.

FIG. 5 is a perspective view of a tension based tension leg platform (TBTLP) which utilizes an artificial seabed at a water depth that enables a TLP to work technically and economically. As discussed above, the conventional technology limits the TLP to water depths of 4000 ft. The present tension based tension leg platform (TBTLP) places an artificial seabed at a water depth of 4000 ft to support the 4000 ft water depth TLP, thereby extending capacity of the 4000 ft TLP to 8000 ft water depth.

A tension base for tension leg platforms is shown and described in my U.S. Pat. No. 5,707,178, titled "Tension Base For Tension Leg Platforms", which is hereby incorporated by reference in its entirety.

The artificial seabed is a submerged platform made of internally stiffened box structure. The artificial seabed is a complete finished box closed on all sides with inlet and outlet valves for the water entrances. The box is flooded with water inside and is open to the deep ocean with openings for inlet and outlet. Control valves are provided to perform controlled ballast to the box. The water flooding inside the box and pumping outside the box may be regulated to lower the box to the desired depth. The artificial seabed box is provided with an open section for the purpose of well accesses by production risers.

The effect of water pressure at 4000 ft is not a critical issue in the structural design of the box material as the inside and outside water pressures are same. The same box is used for the construction of the columns in the shipyard to place the columns above and skid into the ocean. The box is also used for local dry transport of the hull with or without the deck as designed accordingly. In the transport condition, the box is buoyant with the inlet and outlet valves closed. Thus the box may be used in all the stages of the TBTLP installation.

Alternatively, a more simplified method for providing the artificial seabed is to utilize a stiffened flat plate with a center opening for well access instead of the box to act as a submerged artificial seabed. The submerged artificial seabed is vertically moored by another independent set of lower tendons to the real seabed at 8000 ft water depth. In addition to the vertical tendon moorings, the artificial seabed is optionally provided with lateral resistance by conventional mooring lines with wire ropes.

The purpose of the artificial seabed is to provide vertical and horizontal resistance to the tension leg tendons that are mounted on top. When the platform heaves due to the wave forces, the artificial seabed resists vertically with the large added mass of the column of water standing above the vertical area of the base. Thus, the artificial seabed base is preferably designed for this condition. The horizontal resistance is provided by the moorings and also from the added mass of the vertical side flat area of the box. The added mass provides resistance to movement in the vertical and horizontal direction for the artificial seabed and it behaves like a real seabed.

Thus, a TLP which is designed for 4000 ft is mounted on top of the artificial seabed, making the TLP economical in deepwater application of 8000 ft depths or more.

It is important to note that both the upper and the lower tendons are always retained in tension due to excess buoyancy of the TLP hull. The submerged base could not carry buoyancy due to large external water pressure. If design permits, additional buoyancy chambers may be added to the artificial seabed as needed. The submerged buoyant base is located at deepwater where the wave particle activities are null. Thus the wave force on the base is not seen.

Principles of TBTLP

The tensioned based tension leg platform utilizes a double pendulum principle by which it avoids tether slacking in very deepwater without increasing the size of the hull near the water surface. The top TLP which is mounted on top of the artificial seabed sways about the pivot at the artificial seabed at 4000 ft instead of the actual seabed at 8000 ft. The vessel size is same as the vessel designed for 4000 ft. The TBTLP wave offset, set-down, and consequently the tendon slacking effect are reduced to a much greater extent. The TBTLP uses a lateral resisting mooring system to the submerged base to reduce offsets due to underwater currents and horizontal forces resulting from the reactions of the upper tendons due to the TLP sway. The added mass in the axial and the lateral directions of the submerged base restrain the motions of the artificial seabed underwater. That makes the artificial seabed behave like the actual seabed. Thus, the effective water depth for the surface TLP has been reduced from 8000 ft to 4000 ft. Consequently, the sway period and amplitude of the surface TLP are dramatically less compared to a conventional TLP.

The weight estimation in Table 2 is revised and reproduced in Table 3, below, to illustrate the characteristics of the TBTLP truss-pontoon hull with the artificial seabed shown in FIG. 5. The hull is sized for 4000 ft water depth. Significant reduction in the hull sizes and the hull weight is obtained with the tension based technology applied to the TLP. This is mainly because of the reduced effective water depth applied to the hull. This significantly solves the TLP hull problem for ultra deepwater applications. However, the riser and the tendon design problems remain unsolved yet for a complete application of the system in deepwater.

TABLE 3

Tension Based TLP Design

| | |
|---|---|
| Water Depth | 8000 ft (eqv. 4000 ft) |
| 100 yr Wave | Hs = 51.8 ft & Tp = 15.2 s |
| Production oil, gas | 100 kBD & 50 mcftpd |
| Deck Pay Load | 17,000 short tons |
| Deck Self Weight | 7,000 short tons |
| Hull Weight | 16,000 short tons |
| Riser Tension | 21,000 short tons |
| SCR + Umbilical | 6,000 short tons |
| Total Down Load | 67,000 short tons |
| Tendon Pretension | 24,000 short tons |
| Displacement | 91,000 short tons |
| Sq. Column Side | 85 ft (26 m) |
| Draft | 100 ft (30.5 m) |
| Column Spacing | 213 ft (65 m) |
| Free board | 100 ft (30.5 m) |

TLP with Riser Support Tower

As set forth in Table 3, above, the riser top tension load on the hull is 21,000 short tons. That significantly affects the efficiency of the TLP design in ultra deepwater. Top tension riser systems are used for the conventional TLP for the dry-tree unit. In water depths of 8000 ft with high pressure and high temperature (HP/HT) applications, the riser weight is large thereby increasing the hull size. If the riser load could be moved out from the shoulder of the hull, then the TLP may be smaller.

Table 4, below, assumes the tension base technology described above applied to the TLP, but assumes no riser top tension load to the hull design. The resultant hull size estimation is very attractive to the oil and gas industry with feasible steel weight and feasible fabrication and installation costs. The overall hull is cost effective for 8000 ft water depth and is less than 4000 ft water depths. Note that this is without the riser issues. The heave, pitch and surge natural periods are obtained for this design are shown in Table 4. The heave and pitch periods are 3.85 sec and 2.75 sec respectively. Those are less than 5 sec. The surge period is 90 sec. This is reduced due to the effect of the artificial seabed. The results are very attractive for 8000 ft water depth. The hull and the tendon size are very reasonable for this design and for this water depth. The riser problems are dealt with in independent tower support.

TABLE 4

TBTLP Design with Riser-Tower

| | |
|---|---|
| Water Depth | 8000 ft (eqv. 4000 ft) |
| 100 yr Wave | Hs = 51.8 ft & Tp = 15.2 s |
| Production, Oil and gas | 100 kBD & 50 mcftpd |
| Deck Pay Load | 17,000 short tons |
| Deck Self Weight | 7,000 short tons |
| Hull Weight | 11,000 short tons |
| Riser Tension | 0 short tons |
| SCR + Umbilical | 6000 short tons |
| Total Down Load | 41,000 short tons |
| Tendon Pretension | 24,000 short tons |
| Displacement | 65,000 short tons |
| Sq. Column Side | 70.0 ft (21 m) |
| No. of Col | 4 |
| Draft | 102 ft (31 m) |
| Column Spacing | 200 ft (61 m) |
| Free board | 82 ft (25 m) |
| Tendon Size | 29 in dia × 1.5 in wt |
| No. of Tendons | 12 |
| TLP-Heave Period | 3.85 sec for 8000 ft wd |
| Surge Period | 90 sec (*) |
| Pitch Period | 2.75 sec (*) (8000 ft) |

Purpose of the Riser Support Tower

Figure 6:
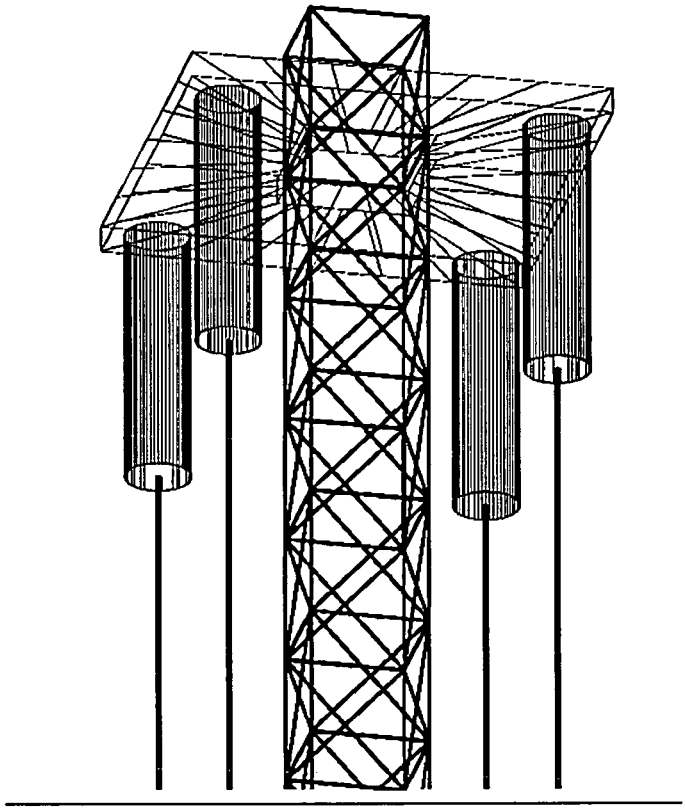
FIG. 6 is a perspective view of a tension based tension leg platform (TBTLP) which utilizes a centrally located riser support tower; the artificial seabed tension base, truss pontoon, and truss extensions are not shown for purposes of clarity and to avoid confusion.

FIG. 6 is a perspective view of a tension based tension leg platform (TBTLP) which utilizes a centrally located riser support tower; the artificial seabed tension base, truss pontoon, and truss extensions are not shown for purposes of clarity and to avoid confusion. This embodiment introduces a riser support tower which is compliant to waves and is adequate to take the riser pretension along the length of the tower in its free standing position. The purpose of the riser support tower is not only to move the riser weight out of the hull size but also to solve the riser design problems in the ultra deepwater environment with high pressure/high temperature (HP/HT) requirements. The riser weight of 21,000 short tons is distributed and supported along the length of the riser. The riser support tower uses the conventional jacket frame structure practice in supporting the conductors in shallow water technology. The slim riser tower is made of a welded steel frame structure with circular pipes Like horizontal conductor support frames, the riser tower has horizontal riser support frames at every interval of the design span. This suppresses vortex induced vibration of the free standing risers in deepwater in 8000 ft water depths. Multiple risers are compactly grouped together within a frame of truss structures along their length with intermediate horizontal supports. The tower takes the vertical load of the risers with inbuilt buoyancy at uniformly distributed intervals. Thus, the tower takes only the vertical load of the risers distributed along the height and not at the top. The tower houses the risers and protects them to some extent horizontally. The tower with the risers behaves with integrity and is compliant to the waves. Thus, the tower is designed similar to a compliant tower with no topside load. Its cross section dimensions are adequate to house all the production risers. It should be understood that the previously described tension base, truss-pontoon and extended truss features may be used in addition to the riser support tower.

The riser support-tower is allowed to move independently with respect to the TLP hull in the vertical direction. The TLP and the tower are coupled in the horizontal oscillations. The risers are supported laterally along the length of the tower at every span of spacing of the horizontal bracing of the tower. Thus, the riser would not experience any VIV (vortex induced vibration) problem in its lifetime and the riser steel weight is reduced significantly.

Installation of the riser support tower may be carried out efficiently with the risers inbuilt within each segment of the tower, utilizing conventional riser connection techniques to connect the risers between the tower bays. For example, threaded connections are very common in the drilling industry to connect pipes together on-board. Each riser is supported with additional distributed buoyancy along the riser length, for example by clamping the risers to the tower to transfer loads.

The horizontal motions of the hull and the tower are coupled to each other. Both the TLP and the riser tower are designed to be compliant to waves in the horizontal response. Since there is no vertical restraint by the TLP to the tower structure, no buckling problem would be seen in the global response of the system to the tower for surge and sway. The riser tower is drag dominated and the TLP is wave inertia dominated design.

Thus, the riser tower does not add additional wave loads to the TLP it its sway mode, and does not disturb the heave motion of the TLP. The tower with drag dominated wave load provides separated flow drag damping to the TLP and further reduces the offset and set down problems. The riser tower thus enhances the TLP design in addition to providing support of the risers. The tower along with the extension supports the tendons horizontally outward in the submerged water in the tendon VIV problem regions. Thus, the fatigue life of the tendons is also enhanced.

TBTLP with Semi-Submerged Riser Support Tower

Figure 7:
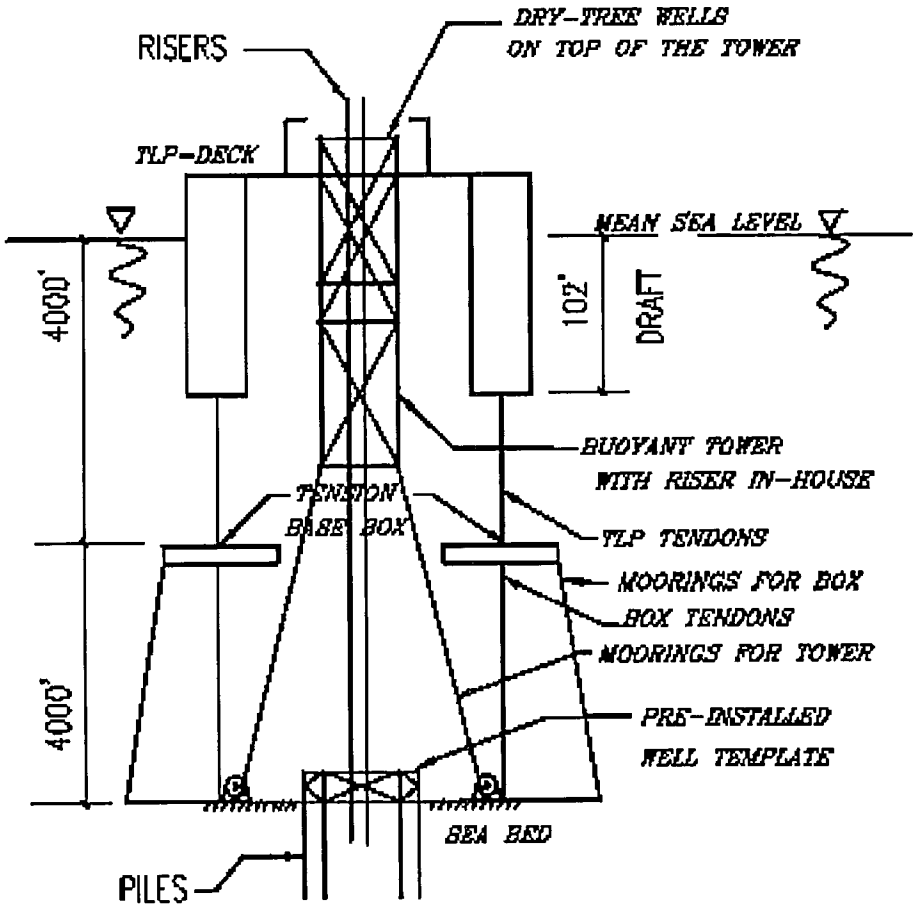
FIG. 7 is a schematic side elevation view of a TBTLP with a shorter semi-submerged riser support tower.

FIG. 7 shows, somewhat schematically, a schematic side elevation view of a TBTLP with a shorter semi-submerged riser support tower. The shorter riser support tower makes The TBTLP more cost-effective. As discussed above, the purpose of the riser support tower is to shoulder the riser weight along the length of the tower with distributed buoyancy. A conventional tower would need a foundation and special fixity if extended all the way to the seabed. Alternatively, the shorter tower may have a length designed just to take care of the riser weight such that the buoyancy is distributed without extending all the way to the seabed. Vortex induced vibration is one factor to be considered in designing the length or depth of the tower. Motion, wave loading, compliancy between the TLP and the tower, etc., also control the design depth of the tower.

The shorter semi-submerged riser support tower illustrated in FIG. 7 is derived from the tower discussed above with reference to FIG. 6, and has several additional advantages. The shorter tower structure is very simple; installation is easy and more compliant to waves and the TLP for better coupling effect. The previously described tension base or artificial seabed may be used as an option in this embodiment. As discussed previously, the submerged artificial seabed, if used, is fully ballasted to take care of the external water pressure at 4000 ft, and it is moored vertically by lower tendons and moored horizontally by catenaries. The tower is sized with shorter depth and has distributed buoyancy to take the 21,000 tons of riser vertical load. The tower is, thus, free from the horizontal loads and structural moments along the span. It is an independent floating structure with very deep draft but framed like a jacket. Buoyancy may be provided in various ways. For example, buoyancy chambers may be built into the legs or independent buoyancy capsules may be attached to the legs or risers. As with the previous embodiment, the risers are housed centrally inside the tower frame.

The degree of excess buoyancy required for the tower is lower compared to the TLP hull. As discussed above, the tower is free to move vertically with respect to the TLP and coupled in the sway/surge mode of TLP oscillation. The tower is highly compliant to waves and to the TLP hull for wave motion. Thus, no structural integrity problem is faced. The tower moorings may be attached to the top of the artificial seabed box like the TLP tendons. This further simplifies the design.

Modified Semi-Submerged Riser-Tower

Figure 8:
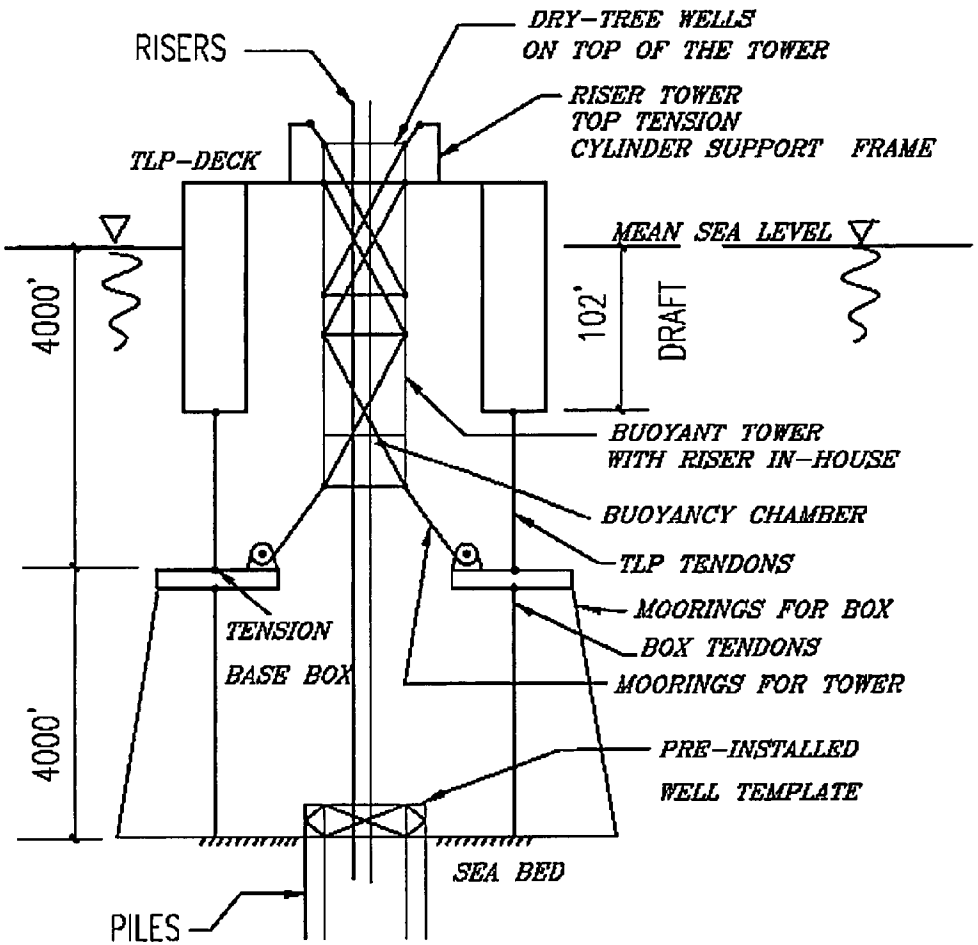
FIG. 8 is a schematic side elevation view of a modification of the TBTLP with a shorter semi-submerged riser support tower wherein top tensioned hydraulic cylinders supported by the TLP top deck top.

FIG. 8 shows, somewhat schematically another modification of a TBTLP with a shorter semi-submerged riser support tower wherein top tensioned hydraulic cylinders supported by the TLP top deck top with a frame. The excess buoyancy on the tower and the relative motion between the tower and TLP is controlled by the top tensioned cylinders. This ensures the riser integrity in 8000 ft water depth service without slack.

Dynamic Mathematical Model

The dynamic characteristic and the structural motion relative to waves of the present invention are significantly different from the conventional TLP concept. The following is a simplified mathematical analysis of the coupled tower and TLP. The axial and the rotational spring stiffness values are very large resulting with large natural frequencies in heave and pitch modes for the TLP hull. The tower is decoupled in those modes. In the cases of the heave/pitch/roll, the effect of the riser support tower is neglected. The lateral spring stiffness values for TLP and the tower are very low. That makes both compliant to wave forces. Notably, the tension base or submerged artificial seabed effect is predominant in the lateral stiffness of the TLP. The surge and sway motions are coupled between the TLP and top of the tower. The tower has lower periods in the sway. A few higher modes of the tower could be close to the wave energy spectrum, but the mode shape keeps them away from wave excitation, hence, it is not critical to the tower design. The linear spring stiffness for the TLP heave, pitch and sway are given below. The tower may be simplified with an equivalent beam column and the TLP may be modelled as a rigid structure with the calculated spring values. The coupled analysis with Morison type wave loading for the TLP columns and with the relative velocity drag damping wave forces for the tower member and the riser members may be obtained in a simplified way to study the combined behaviour of the TLP oscillation with the tower.

Figure 1:
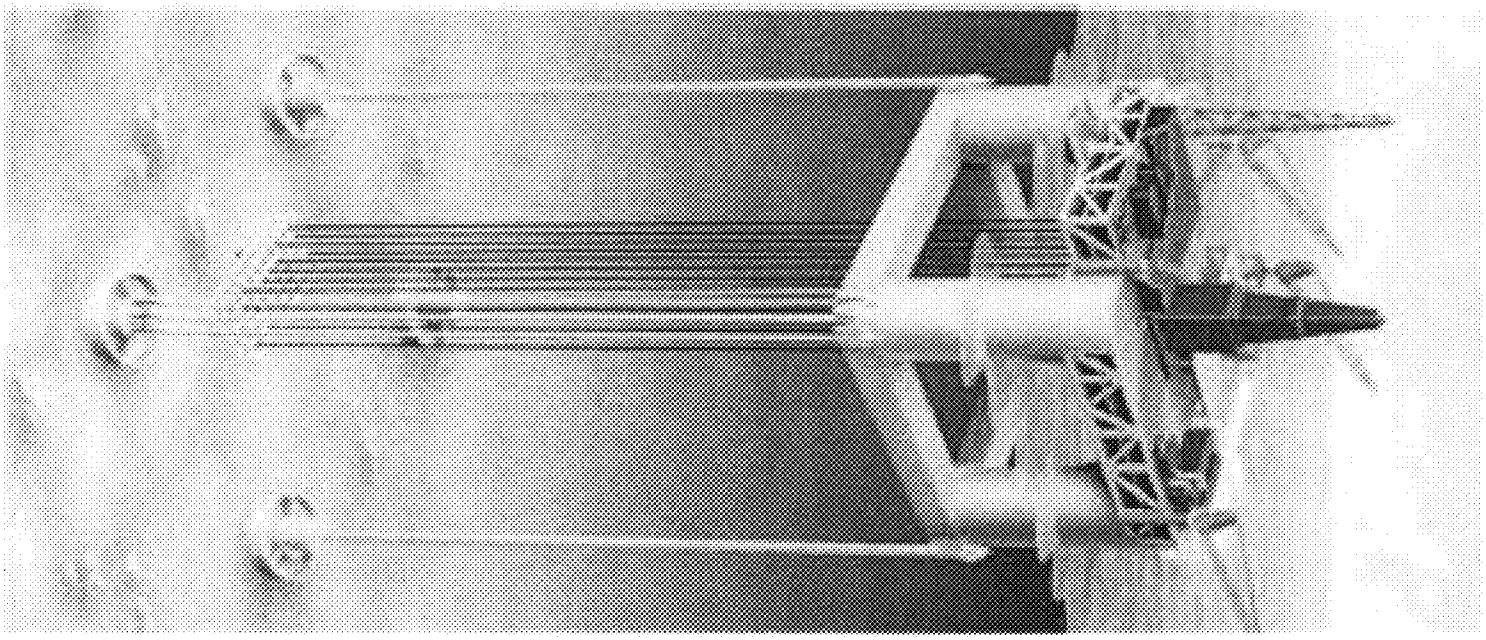
Fig. 1(Prior Art)
FIG. 1 is perspective view of a conventional tension leg platform (TLP) of the prior art.
Figure 2:
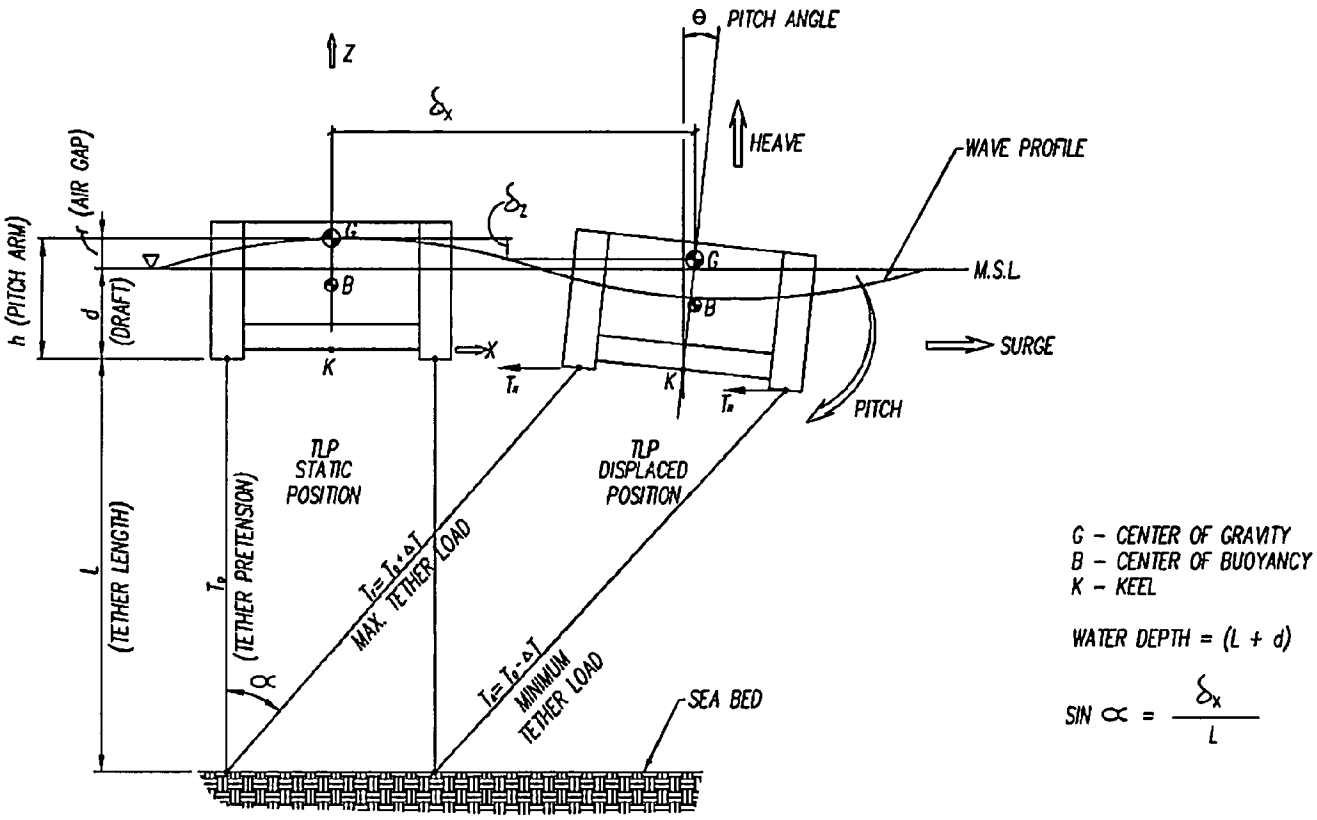
FIG. 2 is schematic side elevation of a conventional tension leg platform TLP of the prior art illustrating the geometric displaced position of the platform in sway with pitch and set-down relationship.

TLP Linear Springs:

Consider the schematic TLP with displaced position as shown in FIG. 2, due to a wave at a time t in its motion history, and unidirectional waves. The vertical, horizontal and rotational spring constants: $K_z$, $K_x$ and $K_o$, respectively may be established. In the diagram, $T_o$ is the tether pretension and $\Delta T$ is the dynamic variation component of the tether tension. The fore and the aft tether tensions are defined as:

$$T_f = T_0 + \Delta T_f \;\&\; T_a = T_0 - \Delta T_a \qquad \text{(Eq.1)}$$

Where W is the total weight of the hull, then the pretension is given by:

$$T_0 = \frac{\Delta - W}{4} \quad \text{(Eq. 2)}$$

where Δ is the hull displacement

The axial stiffness k, on the tethers is defined as:

$$k = \frac{AE}{L} \quad \text{(Eq. 3)}$$

Where A is the area of the cross section of the tethers, E is the young's modulus of the tether material and L is the length of the tethers. Now, Eq. 1 can be defined in terms of k, the tethers axial stiffness and S, the center-to-center distance of the hull column spacing:

$$T_f = T_0 + k\left(\varepsilon + \frac{S\theta}{2}\right) \quad \text{(Eq. 4)}$$

$$T_a = T_0 + k\left(\varepsilon - \frac{S\theta}{2}\right) \quad \text{(Eq. 5)}$$

$$(T_f - T_a) = 2(T_0 + k\epsilon) \quad \text{(Eq.6)}$$

where ϵ is the tether extension $$(T_f - T_a) = kS\theta \quad \text{(Eq.7)}$$

where θ is the pitch angle

Axial Spring:

The axial stiffness has two components: one arising from the tether stiffness and the second from the hydrostatic state of the hull. The axial stiffness spring value $K_z$ is given by:

$$K_z = 4\left(\frac{AE}{L}\right) + 4\rho g A_c \quad \text{(Eq. 8)}$$

where ρ is the mass density of the water $$4T_N = 4T_0 \sin\alpha = 4T_0 \frac{\delta_x}{L} \quad \text{(Eq. 9)}$$

$\delta_x$ is the horizontal displacement

Where L is the length of the tethers. The horizontal stiffness $K_x$, is given by:

$$K_x = \left(\frac{4T_0}{L}\right) \quad \text{(Eq. 10)}$$

Rotational Spring:

The rotational spring is resulted from the pitch restoring forces and is defined as:

$$K_\theta = \Delta\overline{KB} - W\overline{KG} + \frac{K_z}{4}S^2 \quad \text{(Eq. 11)}$$

where $K_z = 4(k + \rho g A_c)$

Wherein KB is the distance from the keel to the center of buoyancy and KG is the distance from the keel to the center of gravity (FIG. 2).

Installation Techniques

Figure 9:
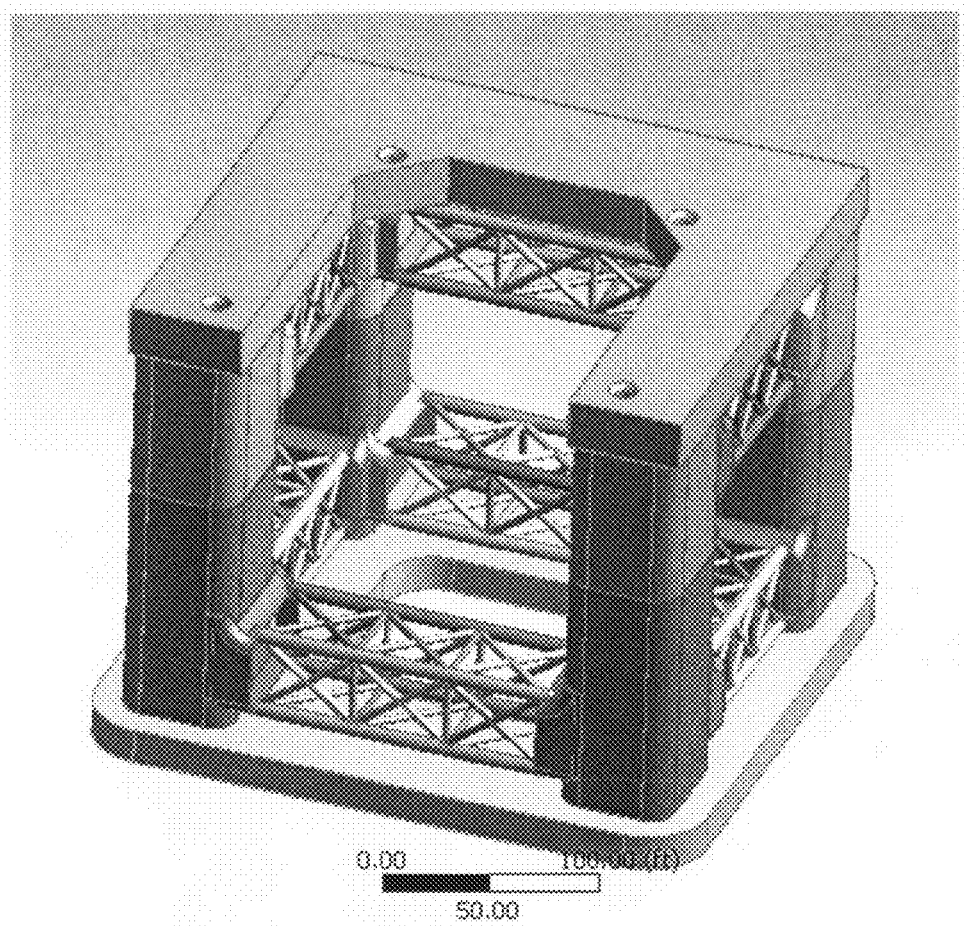
FIG. 9 is a perspective view of a tension based tension leg platform (TBTLP) supported on the tension base box in a transport mode.

The TBTLP hull resulting from the four technologies described above make the hull design and fabrication very simple. It is based on the four major vertical columns with tubular frames welded horizontally therebetween as truss connections. The C-frame type deck may be used if float-over deck installations are selected. The riser support tower reduces the overall hull weight. The entire deck with all equipment may be assembled on top of the slim hull. The total transport weight of the hull with deck and pay load is about 35,000 short tons as per Table 4. Such a low weight structure may be dry-transported by large transport barge in ocean voyage from the fabrication yard of one part of the world to the installation site of another part of the world. Several barges may qualify to do the voyage with the fully equipped deck on the hull. The tension base may be utilized for the local transportation and installation. The tension base box may be buoyant when constructed with water inlet and outlet valves. Thus, in a transport mode, the tension base box could be sized to carry the hull and deck in transportation draft as shown in FIG. 9. At the installation site, the tension base box is flooded slowly and lowered to the submerged position at the designed water depth.

Figure 10A:
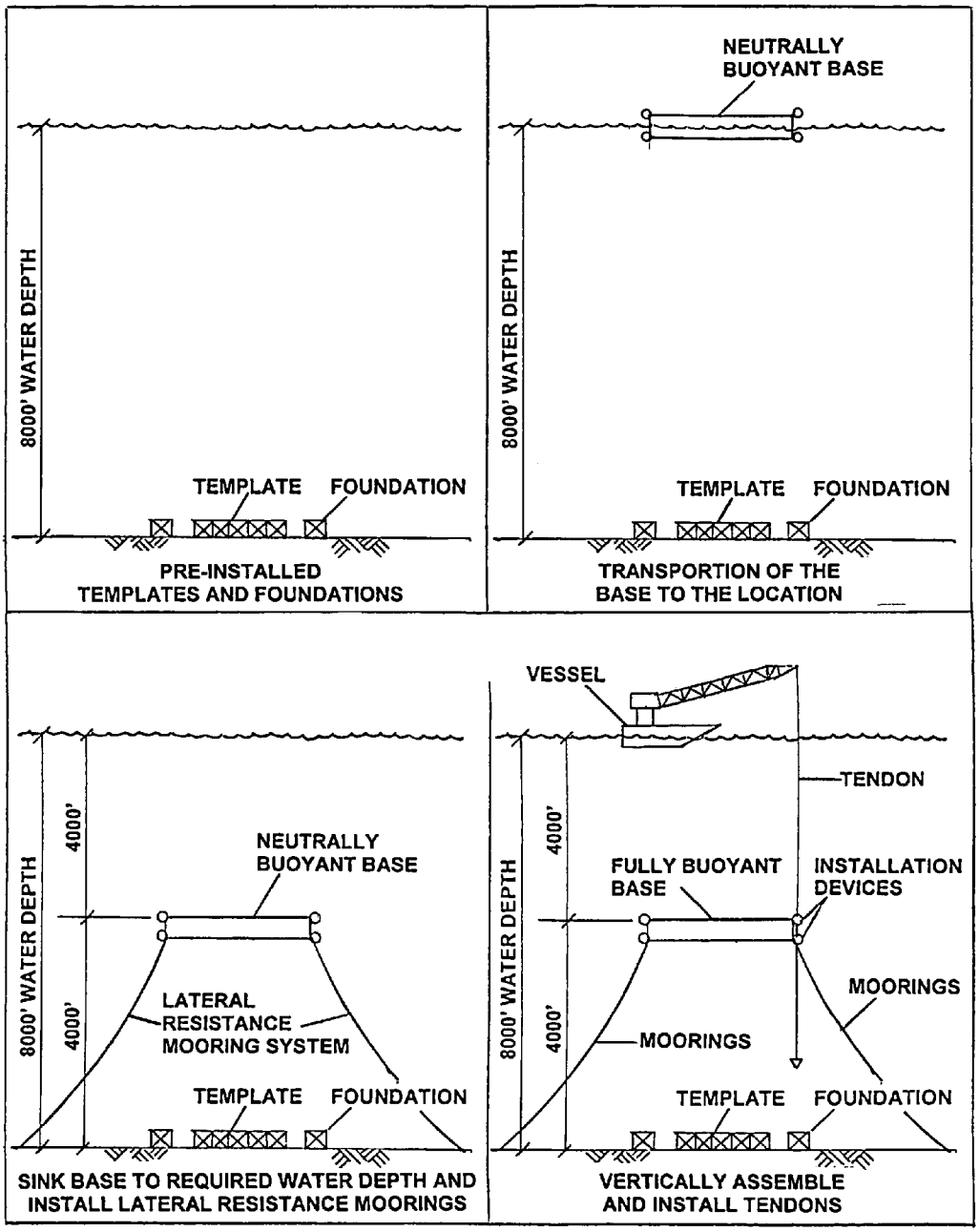
FIG. 10 is schematic illustration of a typical installation the tension based tension leg platform (TBTLP).
Figure 10B:
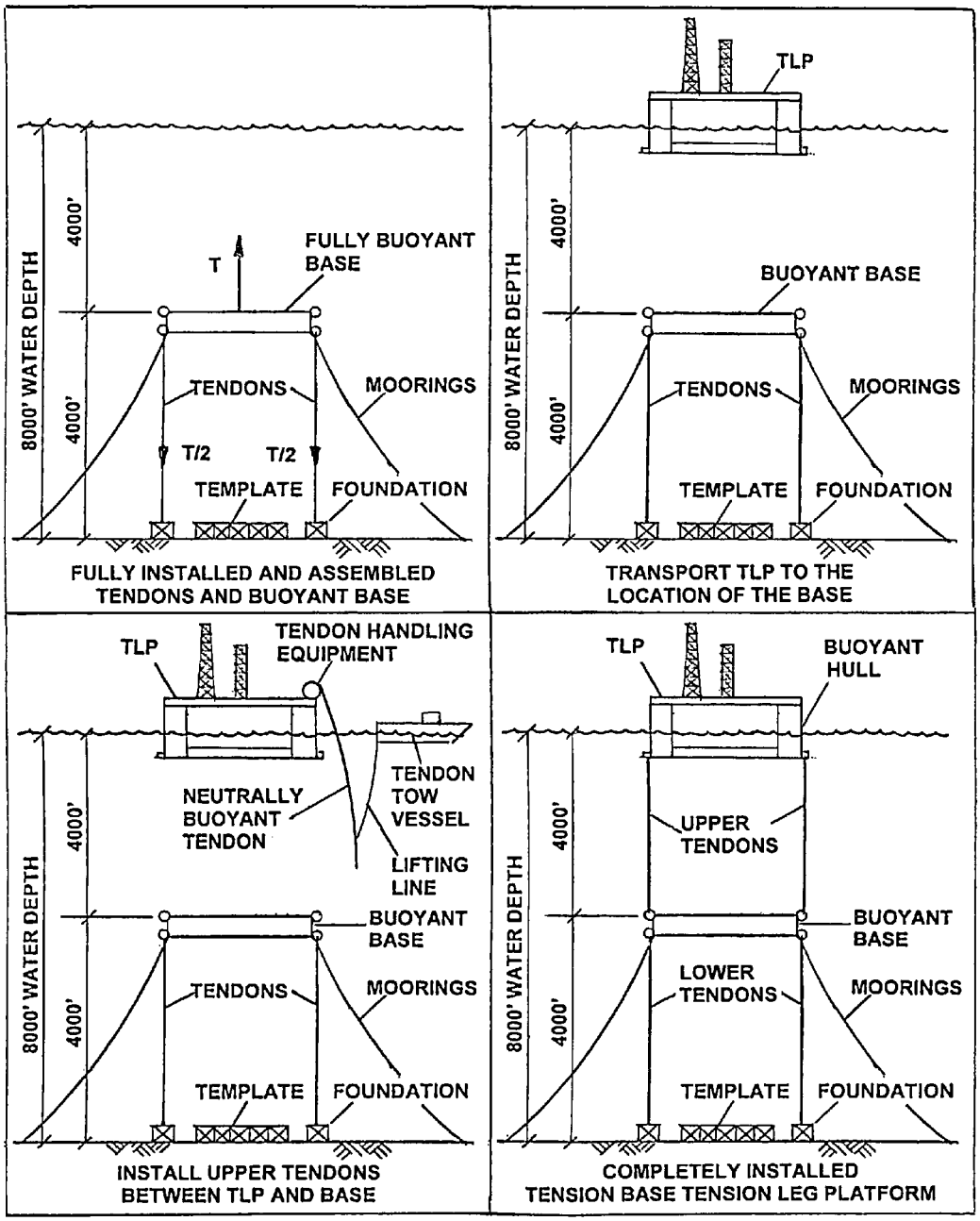

A typical installation of the TBTLP is shown in FIG. 10. Several other installation methods could be obtained based on the past experiences gained from the TLP installation. The hull can also be towed to the site in a free floating position with the help of the tension base. The central tower is fabricated. The tower is divided into a number of small sections. There are four main legs to the tower with diameters of 50" to 70" depending upon the design. Because of the smaller structural size, the tower can be fabricated like a shallow-water fixed jacket platform. The tower can be fabricated at different yards in parallel. This reduces risk and the cost involved in the fabrication, transportation and the installation of the tower. The tower also can be fabricated in longer lengths and installed.

Once the tower is fabricated by sections and then transported to the offshore location, the installation of the tower is carried out by telescoping the tower sections one after another through the center opening of the deck. The risers are supported in the middle of the tower. They are supported at every horizontal bay like a jacket platform. The riser buoyancy is added to the tower in the design. This may be achieved from the larger legs or independently added at the bottom of the tower frame or distributed along the height. The connection between riser sections is also made as discussed previously.

Figure 11:
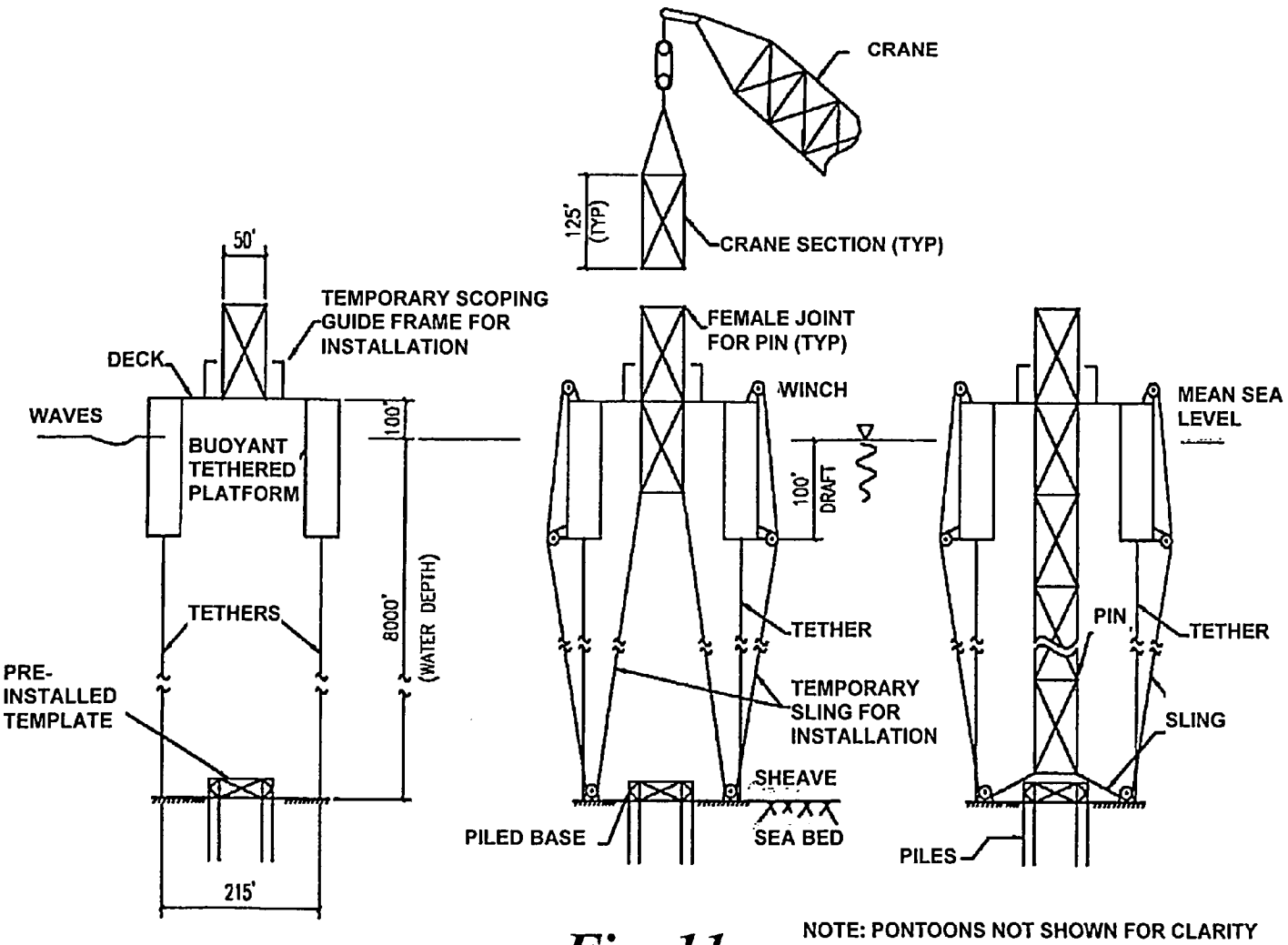
FIG. 11 is schematic illustration of a typical installation the riser tower of the tension based tension leg platform (TBTLP).

The bottom base of the center tower and the template for the hull tethers are preinstalled on the seabed. The hull is towed to the site and the tethers are installed. The tower sections are added one-by-one using a crane and telescoped downwards to the seabed. Temporary slings and guide frame are used for smooth and quick installation of the tower. The details and sequence of tower installation is shown in FIG. 11. This is a very unique and most reliable installation procedure specially developed for the TLP concept. Each section is either mechanically connected to the other or it can be field welded. The installation will be much faster if mechanical connections are used. After the installation of the tower, the slings and the telescoping guide frames will be removed.

The practical depth limits of conventional TLPs with steel tendons a well known problem in the industry. Attempts to achieve cost effective development have increased the deck facility and production capacity that result in larger deck load. New generation TLPs installed recently also can not effectively extend the water depth limit beyond 4300 ft for the Gulf of Mexico harsh environment. The increased riser top tension loads exceed the deck topside loads in ultra deepwater and the weight of top tensioned risers has substantially kept the TLP technology away for ultra deepwater applications.

Although several alternate dry-tree support vessels have been developed and used, the TLP is still a preferred candidate structure for many oil and gas companies. This is because of the high reliability and past practical initialization. The SPAR is typically not recommended by engineering companies for ultra deepwater applications because of fabrication, transportation and installation complexities.

The present invention presents emerging technology to extend the application of a TLP beyond 8,000 ft of water depth in the Gulf of Mexico harsh environment, to solve the ultra deepwater problems from the hull design to riser support, and make the TLP a reliable structure for 8,000 ft water depths.

The riser support tower is very practical and solves the real world riser problem. This enhances the reliability of the risers in such large water depth for oil production application. The riser support tower also aids the TLP in reduction of set-down and offset motion. The decoupling between the riser tower and TLP in the vertical and rotational mode of the oscillation and their coupling in the sway and surge modes create friendly motion behavior between the two structures without hurting each other. The semi-submerged riser support tower has excellent mechanical behavior for the system requirement at 8,000 ft in the most cost effective way and is the most suitable for the dry-tree support. The tower moored to the tension base or artificial seabed makes easier installation.

The riser top tension load is removed from the TLP design, making the hull slim and practical for the tendons. The tension base provides and artificial seabed for the TLP, and the tendon support system is feasible in 8,000 ft water depths. The truss pontoon reduces the wave loading on the vessel, particularly the heave loading that is critical for TLP design.

The tension base box serves a dual purpose; both in the transportation and in the operation mode. It is used for transportation of the hull with the deck on it. Then it is flooded with water and submerged and used again in he operational mode as an artificial seabed at deepwater depths.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A floating tension based tension leg platform system for use in offshore deepwater applications in a body of water to support dry-tree oil and gas production, comprising:

a buoyant ballastable tension base structure submerged a selected distance below the surface of the body of water, said tension base structure connected to a foundation secured on the sea floor and maintained in tension a distance thereabove by a plurality of tensionable lower tendons each attached at an upper end to said tension base and at a lower end to said foundation such that said tension base structure functions as an artificial seabed, said tension base structure closed on the perimeter sides defining an open section for passage therethrough of production risers having a lower end connected to wells on the sea floor;

a floating tension leg platform including a hull having a plurality of spaced apart buoyant vertical columns, a deck structure at an upper end of said vertical columns having an opening therethrough, an open framework of horizontal spaced truss pontoon members interconnecting lower ends of said vertical columns together in spaced apart relation, each of said vertical columns having a submerged portion and a non-submerged portion and one or more buoyant tanks or chambers disposed inside said each of said vertical columns or enclosed by bulkheads including ballast control means for selectively adjusting the buoyancy thereof, said floating tension leg platform connected to said submerged tension base structure and maintained in tension a distance thereabove by a plurality of tensionable upper tendons each attached at an upper end to a lower portion of a respective one of said vertical columns and at a lower end to said tension base structure such that said tension base structure functioning as an artificial seabed provides vertical and horizontal resistance to said upper tendons attached to said platform, and resists platform heaves due to wave forces; and an elongate buoyant vertical riser support tower of tubular truss frame construction floating independently of said tension leg platform hull and extending movably through said opening in said floating tension leg platform deck structure to extend above and below said deck structure, said buoyant vertical riser support tower having vertically spaced horizontal riser support members along the length of said tower to receive, secure, surround, and support upper portions of the production risers and support the riser weight along the length of said tower;

said independently floating buoyant vertical riser support tower movably coupled with said tension leg platform to allow axial vertical movement of said tower and said upper portions of production risers secured along the length thereof as a unit relative to said tension leg platform while preventing relative horizontal movement therebetween such that said tension leg platform is free of vertical riser loads and vortex induced vibration fatigue of said supported risers.

2. The floating tension based tension leg platform according to claim 1, wherein said independently floating buoyant vertical riser support tower is movably coupled with said tension leg platform by hydraulic cylinders supported at a first end on said deck structure and connected at a second end with said independently floating buoyant vertical riser support tower so as to control excess buoyancy of said tower and movement of said tower and upper portions said production risers secured along the length thereof as a unit relative to said tension leg platform while preventing relative horizontal movement therebetween.

3. The floating tension based tension leg platform according to claim 1, wherein said tension leg platform deck structure comprises a generally C-shaped or U-shaped deck structure having three box-like generally rectangular sides defining a wide opening between two laterally adjacent main vertical columns of sufficient width to accommodate at least a portion of a barge.

4. The floating tension based tension leg platform according to claim 1, wherein said plurality of tensionable lower tendons are each attached at an upper end to a cross-braced open tendon support frame secured to said lower end of said vertical columns and extending a distance outward therefrom and at said lower end to said tension base structure.

5. The floating tension based tension leg platform according to claim 1, wherein said buoyant ballastable tension base structure is further tethered to the sea floor by a plurality of mooring lines each having an upper end attached to said buoyant ballastable tension base structure and a lower end attached to the sea floor to provide resistance to lateral movement.

6. The floating tension based tension leg platform according to claim 1, wherein said independently floating buoyant vertical riser support tower is tethered to the sea floor and retained in tension a distance above said buoyant ballastable tension base structure by tower mooring lines each having an upper end attached to said buoyant vertical riser support tower and a lower end attached to the sea floor.

7. The floating tension based tension leg platform according to claim 1, wherein said floating buoyant vertical riser support tower is equipped with buoyancy elements selected from the group consisting of interior buoyancy chambers and buoyancy tanks.

8. The floating tension based tension leg platform according to claim 7, wherein said floating buoyant vertical riser support tower truss frame is formed of welded hollow tubular frame members defining said interior buoyancy chambers.

9. The floating tension based tension leg platform according to claim 1, wherein said floating buoyant vertical riser tower truss frame is formed of a plurality sections of tubular frame members, each section having vertical leg members, horizontal crossmembers extending therebetween adjacent to opposed ends of said leg members, diagonal crossmembers extending between said horizontal crossmembers, and mating connectors at opposed ends of said leg members for releasably securing said sections together; and said upper portions of said risers are formed of a plurality of riser sections, each supported within a respective section of said riser tower truss frame, and each riser section having mating connectors at opposed ends for releasably securing said riser sections together along the length of said riser support tower.

10. The floating tension based tension leg platform according to claim 1, wherein said buoyant ballastable tension base is a box-like structure closed on all sides defining said open section for passage of said production risers therethrough and having inlet and outlet valves for controlling the inlet and outlet of water to provide ballast for lowering said tension base to a desired depth and to retain said tension base in tension at said selected distance above the sea floor.

11. The floating tension based tension leg platform according to claim 10, wherein said buoyant ballastable tension base, at said desired depth, is disposed at a deepwater depth at which water particle activity due to wave motion is null.

* * * * *